US006537046B1

(12) United States Patent
Bodzak

(10) Patent No.: US 6,537,046 B1
(45) Date of Patent: Mar. 25, 2003

(54) DEVICE FOR REDUCING THE AXIAL FORCE LOAD OF A FLUID SUPPLY PUMP

(75) Inventor: Stanislaw Bodzak, Elsbethen (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/889,892

(22) PCT Filed: Nov. 10, 2000

(86) PCT No.: PCT/DE00/04006

§ 371 (c)(1),
(2), (4) Date: Oct. 22, 2001

(87) PCT Pub. No.: WO01/38739

PCT Pub. Date: May 31, 2001

(30) Foreign Application Priority Data

Nov. 24, 1999 (DE) ..... 199 56 520

(51) Int. Cl.[7] ..... F04C 2/18; F04C 15/00
(52) U.S. Cl. ..... 418/104; 418/206.1; 418/206.6
(58) Field of Search ..... 418/102, 104, 418/206.1, 206.6

(56) References Cited

U.S. PATENT DOCUMENTS

| | | | | |
|---|---|---|---|---|
| 2,993,450 A | * | 7/1961 | Weigert | 418/102 |
| 3,063,378 A | * | 11/1962 | Hart | 418/104 |
| 3,415,459 A | * | 12/1968 | Reimer et al. | |
| 4,470,776 A | * | 9/1984 | Kostek et al. | 418/102 |

FOREIGN PATENT DOCUMENTS

| | | | |
|---|---|---|---|
| DE | 0152393 | * 11/1981 | 418/102 |
| DE | 3307099 | * 9/1984 | |
| DE | 19714648 | * 10/1998 | |
| EP | 0843096 | * 9/1997 | |
| WO | 99/39103 | * 8/1999 | |

* cited by examiner

*Primary Examiner*—John J. Vrablik
(74) *Attorney, Agent, or Firm*—Ronald E. Greigg

(57) ABSTRACT

The invention relates to a device for delivering fuel from a tank to an internal combustion engine, wherein a pump chamber is embodied in the housing of the feed device. Rotary driven displacing elements are contained in the housing. The shaft supporting a displacing element is provided with bores which connect an end of the shaft to the suction side of the feed device.

7 Claims, 2 Drawing Sheets

DEVICE FOR REDUCING THE AXIAL FORCE LOAD OF A FLUID SUPPLY PUMP

CROSS-REFERENCE TO RELATED APPLICATIONS

This application is a 35 USC 371 application of PCT/DE 00/04006 filed on Nov. 10, 2000.

BACKGROUND OF THE INVENTION

1. Field of the Invention

The invention relates to a device for reducing the axial force load of a fluid supply pump, such as a gear pump, which is used as a fuel delivery pump to supply fuel to the internal combustion engine from the tank of a motor vehicle.

2. Description of the Prior Art

DE 195 138 22 A1 has disclosed a device for delivering fuel from a tank to an internal combustion engine used to drive a motor vehicle. In this embodiment, a delivery line from the tank to the engine contains a feed pump which has at least one pump chamber in its housing. The pump chamber contains a pair of meshed rotary driven gears, which feed fuel from an intake chamber that can be connected to the tank, along a supply conduit embodied between the face of the gears and the wall, into a pressure chamber that can be connected at least indirectly to the internal combustion engine. In order to reduce the structural space and the manufacturing costs, the housing of the feed pump contains an additional air supply pump whose suction side is connected to a power brake booster of the motor vehicle.

In gear pumps used to supply fuel from motor vehicle tanks, pressures of up to 8 bar can occur. The exertion of up to 8 bar of pressure, which is directed essentially from the delivery side toward the suction side of the pump, produces an axial force that acts on the delivery side feed elements of the pump, which presses an end face of the shaft against a seat face. After long-term operation, signs of wear appear on the seat face; this results in premature wear on the end face of the shaft and on the seat face. One attempt to prevent premature wear on an end face of the shaft was comprised of providing the boundary surface at the intake end of the shaft with a relief groove, which connected the end face of the shaft opposite from the boundary surface to the suction side of the delivery device. But this involves an additional operating phase of milling out the relief groove during production of the boundary surface.

SUMMARY OF THE INVENTION

With the configuration according to the invention of a fuel supply pump, on the one hand its manufacture can be simplified and it can therefore be embodied in a less expensive manner. The wall which defines the feed device on the suction side can now be produced without the additional operating phase of milling out a relief groove in the region opposite from the end face of the shaft contained in the housing. A surface treatment of the groove in the limit wall provided on the suction side in order to increase the surface hardness can also be eliminated so that as a whole, this component is easier to produce. On the other hand, the embodiment according to the invention permits a reduction of the axial force acting on one side of the shaft contained in the housing. Up till now, the axial force produced has resulted in premature wear on an end face due to frictional contact with the seat face of the shaft. By means of the conduit system in the housing of the feed device and in the shaft itself, a relief force, which acts on the shaft in opposition to the axial force, can be produced on a surface area enlargement on the end face of the shaft disposed opposite from the boundary surface. The relief force counteracts the axial force in the shaft and is produced by the application of a negative pressure to a surface area enlargement in the form of a concave curved recess on the end face of the shaft.

In another embodiment of the invention, the conduit system extends in the shaft, underneath a sealing ring supported on the shaft, which ring, on the end face, seals a hollow chamber embodied as a circumferential groove. This hollow chamber communicates with the suction side of the feed device by means of a conduit in the housing.

By means of the conduit system, the negative pressure is applied from the suction side of the feed device to the end face of the shaft where the surface area enlargement is embodied.

The surface area enlargement embodied on the end face of the shaft, for example in the form of a concave curved recess, permits an enlarged effective area for the application of the negative pressure. The greater the surface area enlargement can be embodied, the greater the relief pressure acting on the shaft can be. As a result, the axial force on the shaft generated by the impingement of pressure on the feed device can be counteracted so that premature frictional wear between the limit wall and the end face of the shaft disposed opposite it can be counteracted.

Consequently, an adjustable force equilibrium on the shaft keeps the end face of the shaft from contacting the opposing limit wall and prevents premature wear.

BRIEF DESCRIPTION OF THE DRAWINGS

The invention will be explained in detail below in conjunction with the drawings, in which.

DESCRIPTION OF THE PREFERRED EMBODIMENTS

Figure 1:
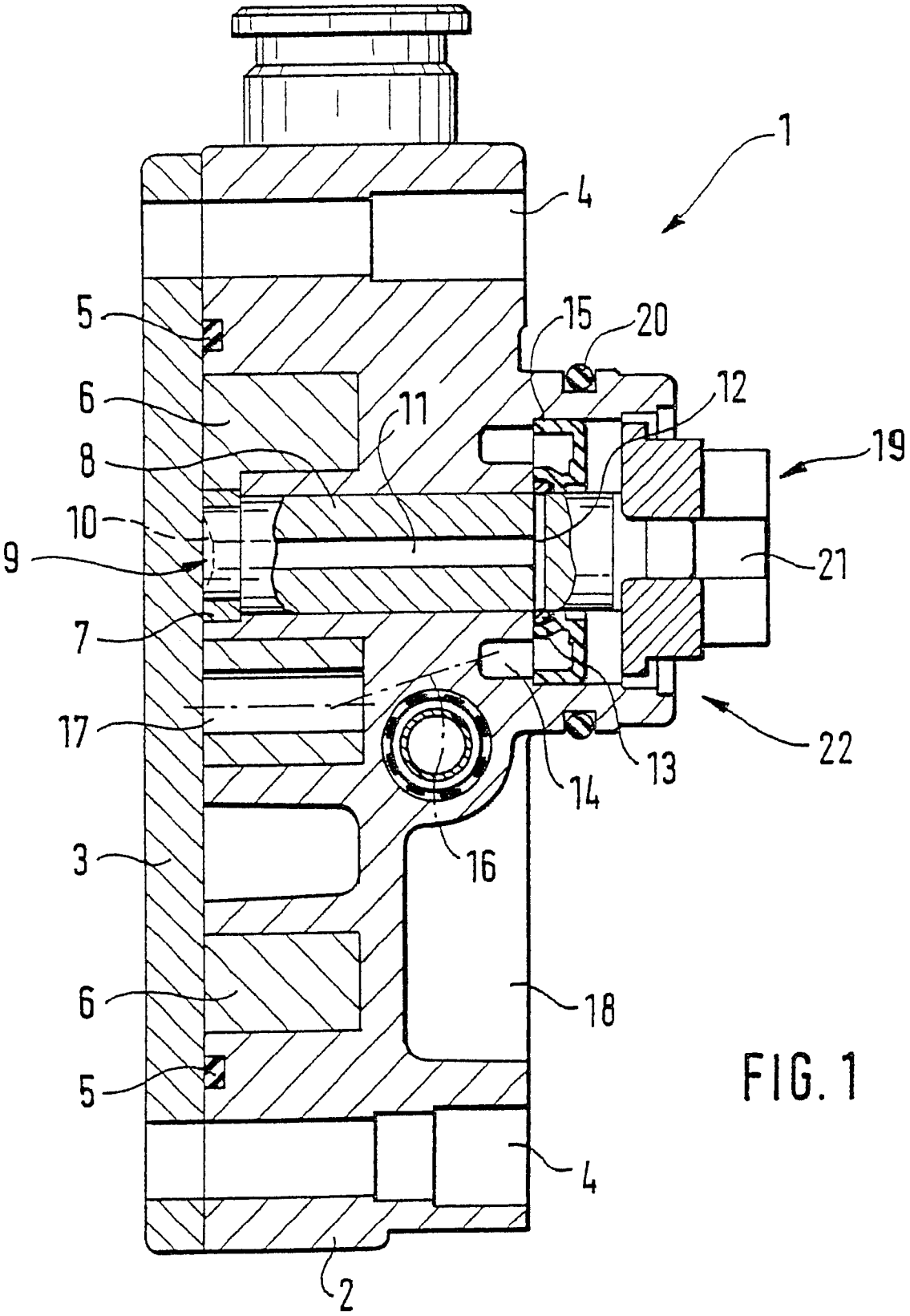
FIG. 1 shows a cross section through a feed device with axial force relief according to the invention.

Referring now to the drawings in detail, the housing 2 of the feed device 1 is closed on the suction side by a boundary surface member 3. A flange is cast onto the side of housing 2 oriented toward the drive mechanism and encloses a coupling element 19. The boundary surface member 3 and the housing 2 have through bores 4. The suction side 17 of the feed device 1 contains housing 2, boundary surface 3, and sealing elements 5, which encompass the displacing elements 6 contained in the housing 2 in the vicinity of the contact surface with the boundary surface 3.

The housing 2 of the feed device 1 contains a shaft 8 that supports a displacing element 6 at one end, which is sealed in relation to the outside by the boundary surface 3. This displacing element 6 supported on the shaft, which is embodied as a butt shaft 8, cooperates with another displacing element 6 supported on the suction side 17. On the drive side 22 of the feed device 1, the shaft supports a claw coupling 19 via which the shaft 8 is driven. The claw coupling 19 has a groove 21 so that a positively engaging drive of the shaft 8 can take place. In addition to a positively engaging drive, frictionally engaging drives via suitable drive connections are naturally also conceivable. For its part, the shaft 8 is penetrated by a through bore 11, which on one end, feeds into the end face region 9 of the shaft 8 and on the other end, feeds into a lateral bore 12 which extends lateral to the rotational axis of the shaft 8 and whose openings feed into the circumference region of the shaft 8.

The lateral bore 12 feeds into the circumference surface of the shaft 8 in the vicinity of a sealing ring 13 supported on the shaft 8. The sealing ring 13 rests with a lower sealing lip 15 over the openings of the lateral bore 12 into the circumference surface of the shaft 8 and seals a hollow chamber 14 provided in the housing. The hollow chamber 14 in the housing is embodied as a circumferential groove in the embodiment shown in FIG. 1. A housing bore 16, which is only indicated here by a center line, extends to the suction side 17 of the feed device 1.

By means of the housing bore 16, which feeds into the hollow chamber 14 in the housing 2, which chamber is encompassed by the sealing ring 13, whose sealing lip 15 permits the shaft conduit system 11, 12 to communicate with the surface area enlargement 10 at the end face 9 of the shaft 8, a negative pressure prevails against the surface of the concave curved recess, which produces a relief force on the shaft 8 that counteracts the axial force. As a result, the axial forces acting on the end face 9 of the shaft 8 can be reduced so that relief grooves 27 in the boundary surface 3 that closes the housing 2 (see FIG. 4) can be eliminated and the component that represents the boundary surface 3 can be manufactured in a less expensive manner.

The flange adjoining the claw coupling 19 for driving the shaft can be provided with an O-ring 20 which, in cooperation with the covering cap, encapsulates the drive mechanism of the feed device 1. The housing 2 of the feed device 1—produced as a cast part—has reinforcing ribs 18, for example, but can also easily be equipped with a smooth surface on its outside similar to the boundary surface 3.

Figure 2:
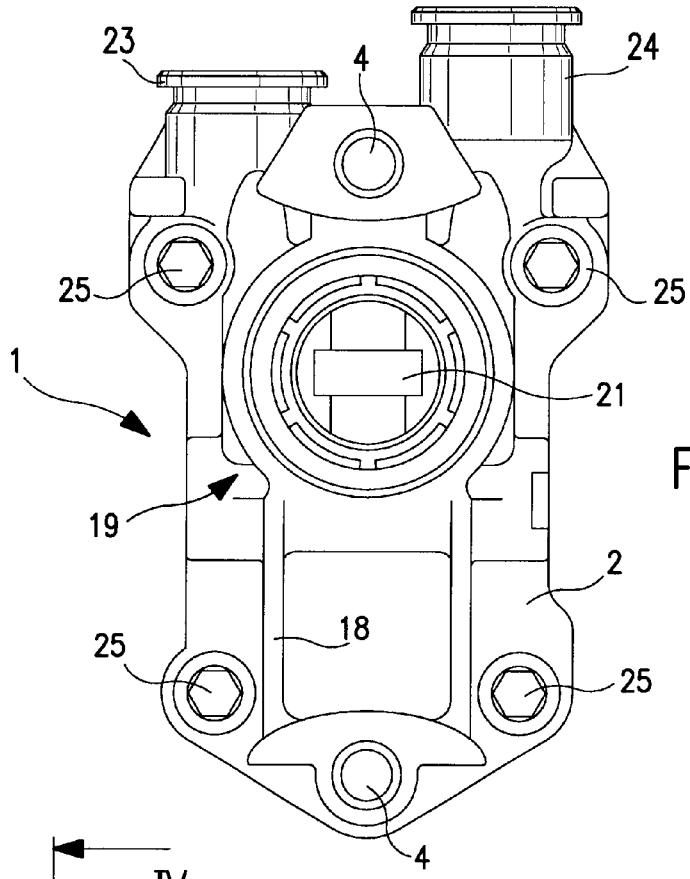
FIG. 2 shows a top view of a feed device according to FIG. 1.

FIG. 2 shows a top view of a feed device according to FIG. 1.

The housing 2 of the feed device 1 is provided with two through bores 4 in the center of the housing. A delivery side 24 and a suction side fitting 23 are embodied on the housing 2 and permit fuel to be aspirated from the tank on one side and pressurized fuel to be conveyed to the injection system of internal combustion engine on the other side. The housing 2 and the boundary surface 3 that seals it are screwed connected to each other by means of four fastening elements 25 respectively accommodated at the corner points of the feed device 1. In the top view according to FIG. 2, it is clear that the end of the shaft 8 is contained with positive engagement between the claws of the claw coupling 19. The claw coupling 19 allows a drive mechanism, not shown here, to provide the rotation of the shaft 8 that supports one of the displacing elements 6, which produce the pressure increase in the housing 2 of the feed device 1.

Figure 3:
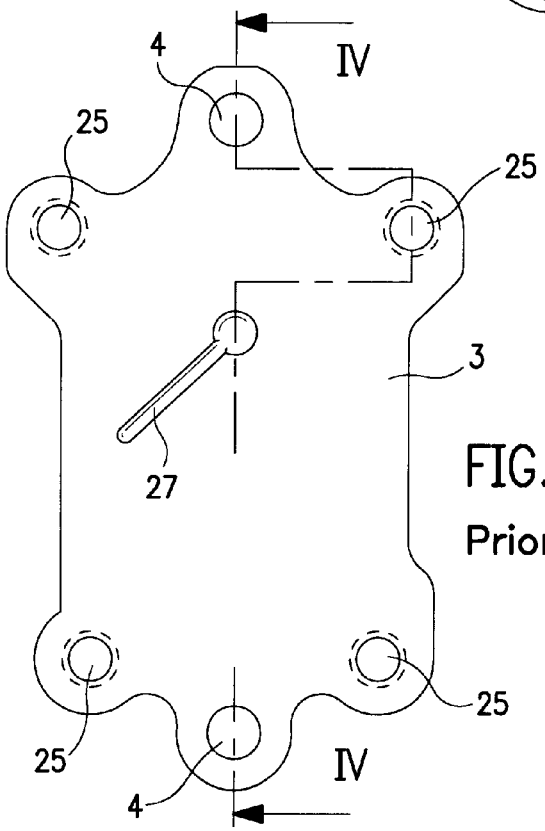
FIG. 3 Prior Art
FIG. 3 shows a view of a related embodiment of the boundary surface oriented toward the suction side.

FIG. 3 shows the feed device limit wall also embodied with a relief groove 27.

In the vicinity of the fastening elements that pass through the housing 2 of the feed device 1, the boundary surface 3 is provided with threads for the fastening elements 25 so that the housing 2 and the boundary surface 3 can be connected to each other. The relief groove 27 extending from the suction side 17 to the end face 9 of the shaft 8 can now be eliminated since a relief force on the shaft 8 supporting the displacing element 6 can be produced by means of the novel conduit system 11, 12 in the shaft 8 and by means of the bore 16 in the housing 2, as well as the hollow chamber in the housing 2.

Figure 4:
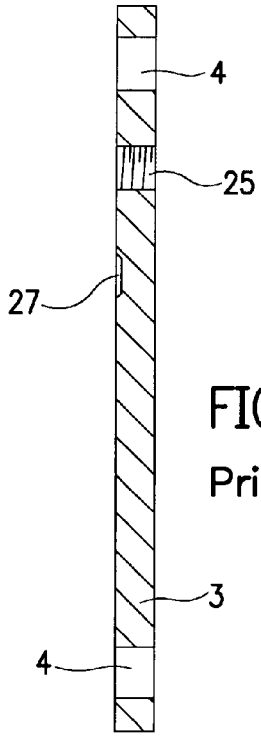
FIG. 4 Prior Art
FIG. 4 shows a sectional view along the line IV—IV of FIG. 3.

FIG. 4 shows the sectional view according to the section IV—IV shown in FIG. 3.

The relief groove 27, shown in a sectional view here, previously required an additional milling step to be executed on the plane 3 delimiting the housing 2, a step which can now be eliminated. The boundary surface 3 can now be produced without such a processing step so that a flat contact of the boundary surface 3 against the sealing element 5 contained in the housing 2 of the feed device 1 can be produced and the displacing elements 6 can each be sealed in relation to the outside.

The foregoing relates to preferred exemplary of embodiments of the invention, it being understood that other variants and embodiments thereof are possible within the spirit and scope of the invention, the latter being defined by the appended claims.

I claim:

1. A feed device for delivering fuel from a tank to an internal combustion engine and having a drive side and a suction side (17), the feed device comprising a pump chamber embodied in a housing (2) of the feed device, rotary driven displacing elements (6) mounted within said housing (2), a shaft (8) driving one of said displacing elements (6), and one end of said shaft having one end face in engagement with said housing, said shaft having bores (11, 12) which connect said one end (9) of said shaft (8) to said suction side (17) of the feed device (1), wherein said shaft (8) has a surface area enlargement (10) on said one end face (9), said surface area enlargement (10) being a concave curved recess, and negative pressure prevailing on said suction side (17) acts against said surface area enlargement (10) by means of said bores (11, 12) in said shaft and a bore and a hollow chamber (14, 16) in said housing.

2. The feed device for delivering fuel according to claim 1, said shaft bores further comprising a bore (11) passing through said shaft (8) and feeding into a lateral bore (12) of said shaft (8).

3. The feed device for delivering fuel according to claim 1, further comprising said housing bore (16) and said hollow chamber (14) being on said drive side of the feed device (1), said housing bore (16) connecting said hollow chamber to the suction side of said feed device.

4. The feed device for delivering fuel according to claim 1, further comprising a sealing ring (13) disposed on said shaft (8), said bores (11, 12) feeding into the region of said sealing ring.

5. The feed device for delivering fuel according to claim 4, wherein said sealing ring (13) comprises a sealing lip (15), said lateral bore (12) opening out underneath said sealing lip.

6. The feed device for delivering fuel according to claim 4, further comprising a circumferential groove (14) in the housing (2), said sealing ring (13) sealing said circumferential groove (14).

7. A feed device for delivering fuel from a tank to an internal combustion engine and having a drive side and a suction side (17), the feed device comprising a pump chamber embodied in a housing (2) of the feed device, rotary driven displacing elements (6) mounted within said housing (2), a shaft (8) driving one of said displacing elements (6), and one end of said shaft having one end face in engagement with said housing, said shaft having bores (11, 12) which connect said one end (9) of said shaft (8) to said suction side (17) of the feed device (1), wherein said shaft (8) has a surface area enlargement (10) on said one end face (9), said surface area enlargement (10) being a concave curved recess, wherein negative pressure prevailing at said suction side (17) acts against said surface area enlargement (10) by means of said bores (11, 12) in said shaft and a bore and a hollow chamber (14, 16) in said housing so as to counter-balance against an axial force which acts on the shaft (8) by fluid under pressure from the drive side of the pump.

* * * * *